United States Patent [19]

Huber et al.

[11] 4,066,249

[45] Jan. 3, 1978

[54] MODULAR VACUUM WORK AREA

[75] Inventors: John G. Huber, Sayville; Ottavio Gianuzzi, Baldwin, both of N.Y.

[73] Assignee: Grumman Aerospace Corporation, Bethpage, N.Y.

[21] Appl. No.: 795,918

[22] Filed: May 11, 1977

[51] Int. Cl.[2] ..... B25B 11/00

[52] U.S. Cl. ..... 269/21

[58] Field of Search ..... 269/21; 248/362, 363; 51/235; 279/3

[56] References Cited

U.S. PATENT DOCUMENTS

| | | | |
|---|---|---|---|
| 2,855,653 | 10/1958 | Kastenbein | 269/21 |
| 3,062,093 | 11/1962 | Wally | 248/362 |

FOREIGN PATENT DOCUMENTS

| | | | |
|---|---|---|---|
| 751,253 | 7/1956 | United Kingdom | 269/21 |

*Primary Examiner*—Robert C. Watson

*Attorney, Agent, or Firm*—Richard G. Geib

[57] ABSTRACT

An improved work area for laminate constructions that is designed to amplify the holding force from that supplied thereto and which accommodates materials of various sizes and configurations.

3 Claims, 2 Drawing Figures

MODULAR VACUUM WORK AREA

BACKGROUND

In order to hold objects to be worked upon it has been suggested in the prior art that one apply a vacuum to a table having openings in its surface which will create suction forces on the object. Various types of structures within the prior art have been suggested such as shown by U.S. Pat. Nos. 3,042,356 and 3,741,116.

In the earlier of these an apparatus is described where an upper plate having a plurality of holes therethrough is placed over a corrugated mat made of a flexible material having passages within it leading to slots communicating with a passage open to a port through a support plate thereunder. There is no suggestion in this reference that the structure could support heavy work without obstruction of the fluid flow path of the sandwiched corrugation or that by sizing openings through the outer plate with regard to the outlet passage for the corrugations one could obtain the results desired with much more practical vacuum apparatus.

In the more recent patent the support table is made of sheets separated by a honeycomb core. The upper sheet is perforated and each core passage of the honeycomb is connected. Therefore, a vacuum drawn through the bottom plate evacuates the entire core in obtaining a negative pressure at the surface for drawing and holding work thereon.

DRAWING DESCRIPTION

FIG. 1 is an isometric view of a modular form of work table having a vacuum system connected thereto to controllably use selected areas to hold work to the table; and FIG. 2 is a cross sectioned view of a part of one of the modules for the table of FIG. 1 showing its internal construction and a valving control thereof.

DETAILED DESCRIPTION

Figure 1:
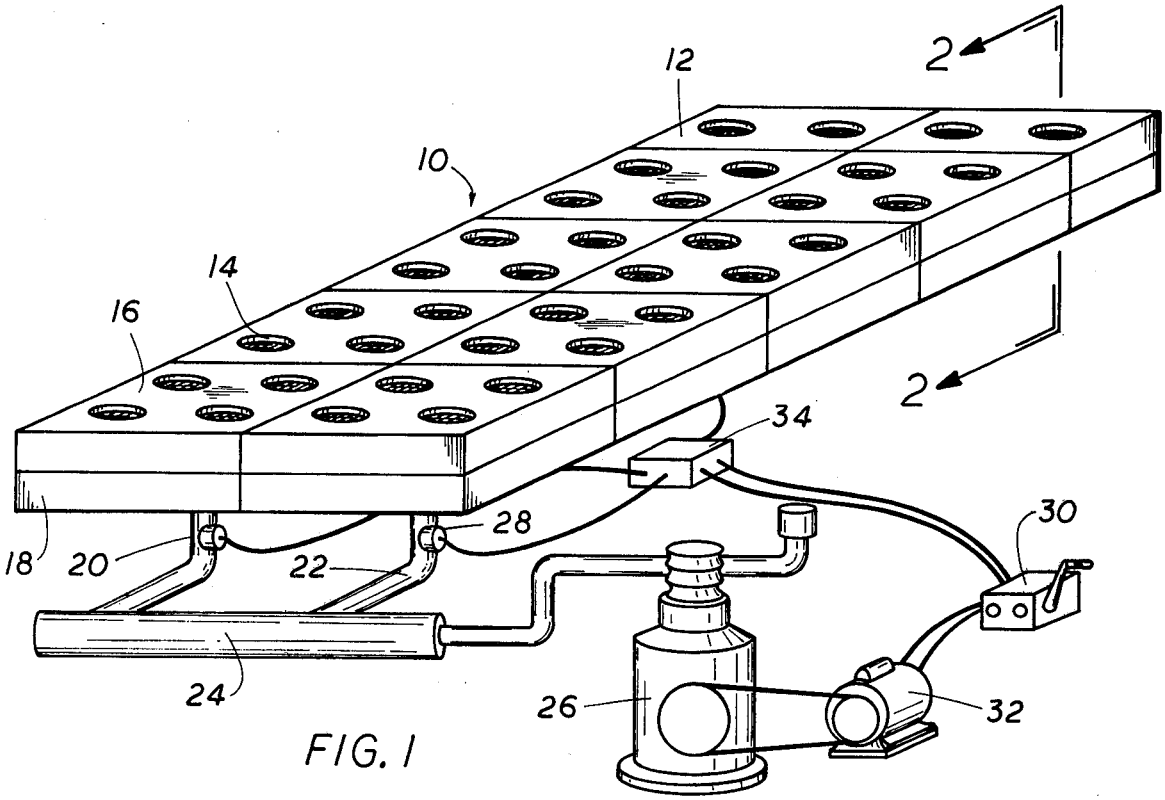

With more particular reference to FIG. 1 there is shown thereby a work table 10 having a plurality of modular elements 12 in its make-up. Each modular element has one or more openings 14 in its surface portion 16 and one or more outlets 20 in its support portion 18. Outlets 20 communicate with pipe 22 leading to a manifold 24 from vacuum pump 26.

The outlets 20 have solenoids 28. A control 30 connects an electrical source to motor 32 for pump 26 and switch box 34 for solenoids 28.

Figure 2:
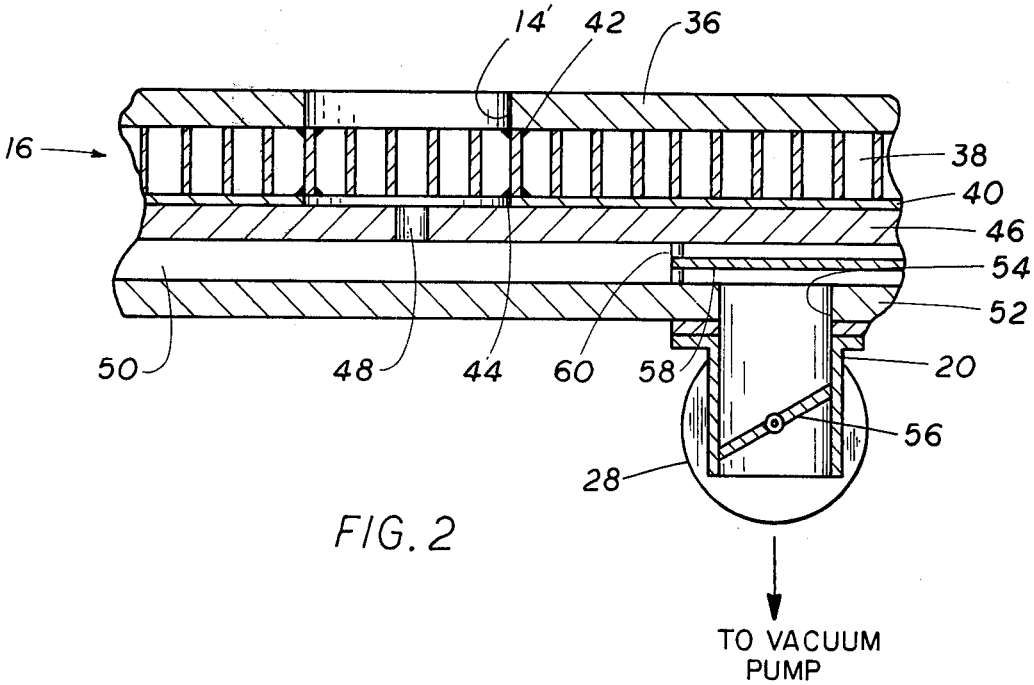

With reference to FIG. 2 there is shown a cross-section of an end module along lines 2—2 of FIG. 1. Clearly delineated by such cross section is the construction of surface portion 16 and support portion 18. The former includes a top plate 36 over a honeycomb core 38 on a distributor plate 40. The top plate is drilled to have an opening 14' overlying passages of cores of honeycomb 38 limited by means of annular seals 42 and 44 to define a passageway from the top plate 36 through the distributor plate 40 of a substantially constant diameter. In a form so far constructed this opening was sized at approximately 25.4 mm.

The support portion has an orifice plate 46 with an orifice(s) 48 underlying the opening(s) of distributor plate 40. In the unit constructed aforesaid this orifice was sized at 2.15 mm. The support portion has a peripheral sidewall 50 from orifice plate 46 to a porting plate 52 opened as at 54 to port piping 20 having valve 56 controlled by the solenoid 28. A baffle plate 58 is supported by small posts 60 to overlie the opening 54 of the porting plate. This prevents the openings 14 in the immediate vicinity of opening 54 for port piping 20 from being at a greater pressure variance with atmospheric than those away from the opening 54.

Not obvious at first is the fact that the above-described structure provides a vacuum handling system which will permit large areas of the vacuum holding surface 12 to be uncovered without severe losses in the holding capability of the system for the area covered by a material to be held to the surface 12. The key concept to be understood is that the structure 10 is in reality a series of vacuum amplifiers which multiplies the static holding force in the ratio of the small port 48 to the area of the opening 14'. More particularly, the larger opening 14' on the surface of modules 12 will permit the static vacuum pressure to be exerted over a large, but controlled area when the hole (opening 14') is covered by an object to be held thereon. When the object is removed from over the hole the air flow loss to the blower or vacuum system (pump 26) is limited by the size of port (orifice) 48.

Having described above an operative construction for this invention it may now be further described and its breadth delineated by the appended claims, as follows:

We claim:

1. A work table to use a vacuum to hold an object to a surface for subsequent working, said table comprising:

a top plate forming the surface on which the object may rest, said top plate having a limited number of openings of a predetermined size therethrough;

a honeycomb having cores underlying said, top plate said honeycomb having the majority of its cores closed on one end by said top plate and a limited number of the cores under the openings therethrough;

a support plate for said honeycomb which closes the other end of said cores save for the limited number equal to the area of and underlying said openings of said top plate; and an orifice plate under said support plate with a port connected to a vacuum source to provide a holding pressure in the limited number of honeycomb cores and at the top plate openings, said port having a restricted orifice in registry with the cores exposed by said support plate whereby the area of vacuum is enlarged from that of the restricted orifice to that of said limited number of cores and thus the top plate openings while air flow is controlled by the restricted orifice at the port to the vacuum source.

2. A work table having means to hold work thereto, said table comprising:

a means to draw a vacuum;

an outer plate having a surface that includes a plurality of openings of a predetermined diameter through it;

a honeycomb bonded to said plate so as to seal all its core passages at one end save for those exposed by said openings;

a support plate bonded to said honeycomb to seal all the honeycomb core passages at the other end save for the one or more partially exposed by an opening through the inner support plate, said support plate opening being of a diameter similar to that of the opening in the outer sheet, said inner support plate opening being able to communicate all the core passages exposed by said outer plate to the one or those partially exposed by the opening of the inner; support plate; and an orifice plate under the support plate connected to the means to draw a vacuum to draw an air flow from the openings of the outer plate via the openings to the inner plate, said orifice plate having a restricted orifice aligned with the opening of the support plate and communicable therewith such that the openings amplifies the vacuum area from that of the orifice and the orifice limits the air flow to the means to draw a vacuum.

3. A vacuum holding system wherein a work table is comprised of modular elements each provided with a limited number of selected areas for the communication of a vacuum source therethrough, said system including:

a manifold with separate valved pipes connecting the modular elements separately to the vacuum source, said modular elements having a restricted orifice providing a substantial restriction in the vacuum outlet for the selected areas such that there is amplification of the vacuum area from the restricted orifice to the selected areas, said modular elements having a baffle plate in the flow path from the restricted orifice to the pipes to equal the vacuum at all said selected areas, said restricted orifice limiting air flow such that all selected areas do not have to be covered for vacuum maintenance at those covered.

* * * * *